US008707751B2

(12) United States Patent
Hielscher et al.

(10) Patent No.: US 8,707,751 B2
(45) Date of Patent: Apr. 29, 2014

(54) METHOD AND APPARATUS FOR PRODUCING HARDENED FORMED PARTS

(75) Inventors: Christian Hielscher, Delbrück (DE); Markus Pellmann, Sassenberg (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 250 days.

(21) Appl. No.: 13/050,500

(22) Filed: Mar. 17, 2011

(65) Prior Publication Data

US 2011/0232354 A1 Sep. 29, 2011

(30) Foreign Application Priority Data

Mar. 23, 2010 (DE) ..... 10 2010 012 579

(51) Int. Cl.
*B21D 31/00* (2006.01)

(52) U.S. Cl.
USPC ..... 72/364; 72/342.43

(58) Field of Classification Search
USPC ..... 72/350, 342.2, 342.6, 364, 342.3, 201; 148/637, 654, 661, 580, 534, 350, 148/342.2, 342.3, 342.6, 364, 644, 658, 148/660, 570, 647, 714, 639, 643
See application file for complete search history.

(56) References Cited

U.S. PATENT DOCUMENTS

| | | | | |
|---|---|---|---|---|
| 1,457,772 | A * | 6/1923 | Forsyth | 148/647 |
| 2,762,734 | A * | 9/1956 | Corral | 148/691 |
| 6,367,304 | B1 * | 4/2002 | Fahrenbach | 72/342.3 |
| 7,254,977 | B2 * | 8/2007 | Machrowicz et al. | 72/342.3 |
| 7,533,553 | B2 | 5/2009 | Knaup et al. | |
| 8,069,697 | B2 * | 12/2011 | Kurisu et al. | 72/342.3 |
| 8,118,954 | B2 * | 2/2012 | Beenken et al. | 148/714 |
| 2009/0162688 | A1 | 6/2009 | Handing et al. | |

FOREIGN PATENT DOCUMENTS

| | | |
|---|---|---|
| DE | 24 52 486 | 5/1975 |
| DE | 26 03 618 | 12/1976 |
| DE | 102005028010 | 7/2006 |

* cited by examiner

*Primary Examiner* — Dana Ross
*Assistant Examiner* — Mohammad Nourbakhsh
(74) *Attorney, Agent, or Firm* — Feiereisen LLC

(57) ABSTRACT

In a method of producing a hardened formed part, in particular for a structure or body part of a motor vehicle, a metal blank is heated and then hot formed in a cavity of a thermoforming mold to produce a formed part. The formed part is hardened in the cavity of the thermoforming mold through contact with a coolant fed into the cavity via feed channels, whereby a state of aggregation of the coolant is adjusted or the coolant is maintained at a pressure above the steam pressure.

18 Claims, 6 Drawing Sheets

METHOD AND APPARATUS FOR PRODUCING HARDENED FORMED PARTS

CROSS-REFERENCES TO RELATED APPLICATIONS

This application claims the priority of German Patent Application, Serial No. 10 2010 012 579.2-24, filed Mar. 23, 2010, pursuant to 35 U.S.C. 119(a)-(d), the content of which is incorporated herein by reference in its entirety as if fully set forth herein.

BACKGROUND OF THE INVENTION

The present invention relates to a method and apparatus for producing hardened formed parts.

The following discussion of related art is provided to assist the reader in understanding the advantages of the invention, and is not to be construed as an admission that this related art is prior art to this invention.

High strength steel sheets which are hot formed and press hardened into formed parts are typically used in the automobile industry for weight reduction and increase in strength in the event of a crash. Hardening of the formed part is realized through cooling, whereby indirect cooling or direct cooling is applicable. Indirect cooling is implemented via cooling channels in the form of bores or slots (shaft cooling) which are arranged in a mold at a defined distance to the molding surface. Coolant, normally water, flows through these channels to dissipate heat, transmitted by the hot formed part to the mold, towards the outside. Direct cooling involves a direct contact of the formed part in the thermoforming mold with the coolant.

Heat transfer and heat dissipation are influenced by contact pressure and a contact between the formed part and the thermoforming mold. The molds are precisely manufactured up to one-hundreds of a millimeter using CNC machines and then surface-treated in an attempt to maintain the gap between the formed part and the mold as small as possible. This has proven difficult in those regions of a formed part that are stretched or have steep grooves because of the resultant presence of air gaps between the formed part and the mold. These air gaps act as insulation, thereby adversely affecting the heat transfer. Air gaps between the formed part and the mold are also encountered as a result of wear.

The cooling process is enhanced by using water as coolant because of its high evaporation enthalpy. Depending on the surface temperature on the formed part, various boiling phenomena can be experienced when the coolant contacts the formed part. When the surface temperature is high, water evaporates and forms on the surface of the formed part a vapor film which has an insulating effect as a consequence of a lesser thermal conductivity compared to the liquid. In the area of film boiling, the formed part thus cools down slower. When the surface to be cooled drops below the so-called Leidenfrost temperature, there is a local and irregularly distributed direct contact across the formed part surface between liquid and formed part. The dissipated heat flow rises in these regions. As soon as the temperature of the coolant drops below the boiling temperature, no evaporation occurs and heat is transferred convectively as the surface of the formed part is completely wetted. The afore-described boiling phenomena or phase states of coolant during cooling could cause local as well as varying and uncontrollable cooldown processes on the formed part. This adversely affects the properties of the formed part and ultimately also impairs product quality.

It would therefore be desirable and advantageous to address prior art shortcomings and to provide more efficient heat transfer and thus improved cooling while allowing adjustment of material characteristic values of formed parts in a reliable and reproducible manner.

SUMMARY OF THE INVENTION

According to one aspect of the present invention, a method of producing a hardened formed part includes the steps of heating a metal blank, hot forming the metal blank in a cavity of a thermoforming mold into a formed part, hardening the formed part in the cavity of the thermoforming mold through contact with a coolant fed into the cavity via feed passageways, and adjusting a state of aggregation of the coolant.

The present invention resolves prior art problems by tailoring the control of the state of aggregation of the coolant. By adjusting the liquid phase as well as vaporous and/or gaseous phase through pressure control and coolant amount control, substantial heat can be dissipated and the cooling process can be better controlled. Moreover, material characteristic values, such as hardness and tensile strength, can be adjusted for the entire formed part or adjusted differently for some regions.

According to another aspect of the present invention, a method of producing a hardened formed part includes the steps of heating a metal blank, hot forming the metal blank in a cavity of a thermoforming mold into a formed part, and hardening at least an area of the formed part in the cavity of the thermoforming mold through contact with a coolant fed into the cavity via feed passageways at a pressure which is above a steam pressure of the coolant and ranges up to 25 MPa.

To improve the contact and thus heat transfer from the formed part to the thermoforming mold, the unwanted air gap between formed part and thermoforming mold or the contact surfaces in the cavity of the mold is closed by coolant that is introduced into the cavity or gap between top and bottom dies of the mold at a pressure above the steam pressure of the coolant. As a result, a stable liquid phase of the coolant can be maintained during the cooldown phase. Evaporation of the coolant is prevented by maintaining the coolant at an elevated pressure above the steam curve. By feeding coolant into the cavity or gap between the formed part and the contact surfaces of the mold, the heat transfer is significantly enhanced compared to a situation involving the presence of air cushions. The heat transfer thus virtually corresponds to a heat transfer when an intimate mold contact exists.

For cooling and hardening purposes, the coolant may contact the formed part in the cavity over the entire surface of the formed part or the contact may be limited to only certain regions of the formed part, depending on whether a fully press-hardened formed part is desired or a formed part is wanted that has regions of different hardness. It is also possible to cool various regions of the formed part in a different manner so as to attain a formed part that has regions of different hardness values and strength properties.

The coolant can be introduced into the cavity at a pressure of up to 25 MPa. This can be done with large volume flows. It is also possible to vary the time period of the coolant supply and/or the pressure level.

According to another advantageous feature of the present invention, a temperature of the formed part in the cavity may be measured. As an alternative, or in addition, it is also possible to measure a temperature of the mold in an area of contact surfaces of the cavity. Advantageously, a starting time and an end time of the coolant supply can be controlled in dependence on the temperature of the formed part and/or the temperature of the mold.

According to another advantageous feature of the present invention, a coolant distribution in the cavity can be variably controlled. A first region of the formed part may hereby be contacted by the coolant whereas a second region of the formed part is prevented from contact with the coolant. It is also possible that first and second regions of the formed part are contacted by coolant in a time-staggered sequence. In this way, the formed part may be tailored with regions of particular material properties.

When regions of the formed part are cooled differently, it is advantageous to securely hold the formed part in place in a cooling station after being removed from the thermoforming mold. This prevents distortion of the formed part as a result of thermal stress.

According to another advantageous feature of the present invention, coolant can be introduced or injected into the cavity at a pressure which is suited to a steam pressure of the coolant in a cooldown phase of the formed part. Depending on the injection pressure, it is possible to produce in the mold gap a water layer with good heat conduction or a wet steam with different heat conductivity.

As described above, the pressure of the coolant may be adjusted in a time-controlled and/or temperature-controlled manner. Advantageously, the pressure of the coolant may be temperature-controlled in dependence on a temperature measurement upon the formed part in the thermoforming mold and/or a temperature measurement upon the thermoforming mold.

According to another advantageous feature of the present invention, the coolant may be injected intermittently into the cavity. In this way, two parameters—pulse duration and frequency—can be controlled that permit also a large-scale production. By tailoring the control of coolant amount per impulse and its timing sequence, substantial heat flows can be dissipated.

According to yet another aspect of the present invention, a thermoforming mold for shaping and hardening a metal sheet includes a top die, a bottom die, with the top and bottom dies defining a cavity there between, wherein the top die and/or the bottom die has feed passageways for conducting a coolant into the cavity, and a control device constructed to adjust a state of aggregation of the coolant.

According to another advantageous feature of the present invention, the control device can be constructed to control a pressure of the coolant injected or forced into the cavity. The control device of the thermoforming mold includes necessary devices such as, for example, high pressure pump, pressure transmitter, high-pressure accumulator, injection control and/or coolant amount control.

Coolant can be injected into the cavity at a pressure, whereby the level of the pressure and/or the injection duration of the coolant can be controlled.

According to another advantageous feature of the present invention, the feed passageways may include supply lines and injection lines branching off the supply lines and porting into the cavity.

According to another advantageous feature of the present invention, the cavity of the thermoforming mold may have contact surfaces which interact with a device to influence heat transmission. Examples of such a device include heating elements, clearances, air gaps, inserts of materials with smaller or greater heat conductivity, or ceramic inserts. This configuration is especially suitable for the production of formed parts that have regions of different hardness.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
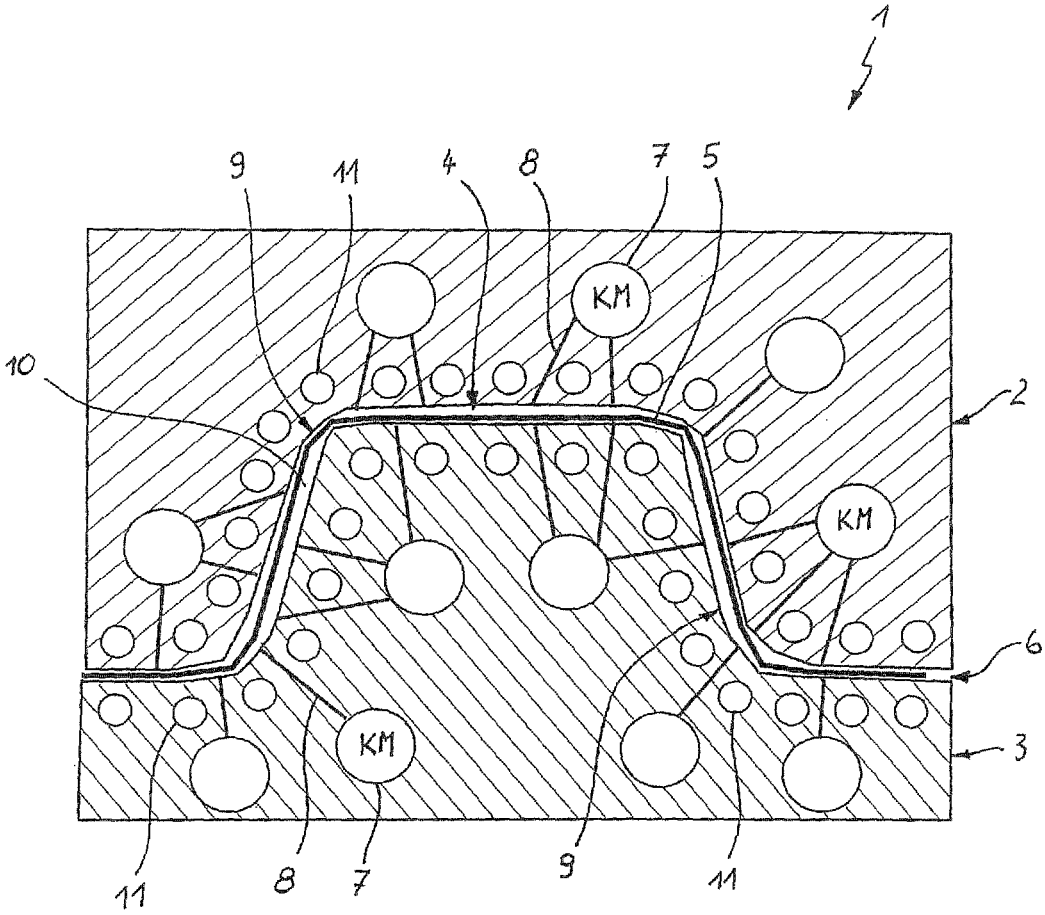
FIG. 1 is a schematic vertical section of a first embodiment of a thermoforming mold according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic vertical section of a first embodiment of a thermoforming mold according to the present invention, generally designated by reference numeral 1. The thermoforming mod 1 essentially includes a top die 2 and a bottom die 3 which are moveable relative to one another and define a cavity 4 there between, when the thermoforming mold 1 is closed.

Clamped in the cavity 4 is a shaped formed part 5 of steel. When the thermoforming mold 1 is closed, a gap 6 is created between the top die 2 and the bottom die 3. The formed part 5 is produced by initially heating a blank of hardenable steel to a hardening temperature above the austenitizing temperature. The blank is then transferred to the thermoforming mold 1 and shaped. While clamped in the cavity 4, the formed part 5 is then rapidly cooled down to a temperature below the martensitic starting temperature and hardened.

Figure 5:
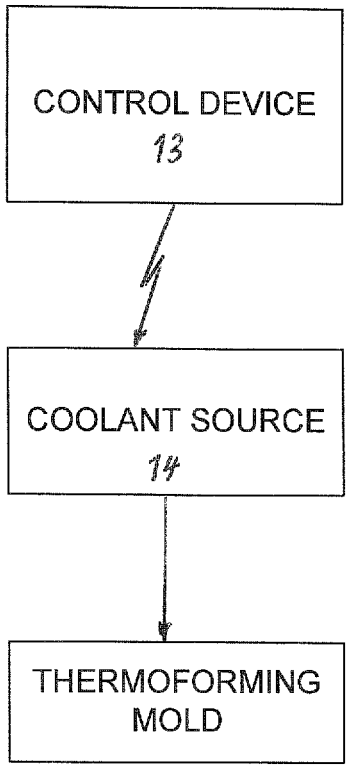
FIG. 5 is a block diagram.

Feed passageways in the form of supply lines 7 are provided in the top die 2 and the bottom die 3, with injection lines 8 branching off the supply lines 7 and leading to the cavity 4. To cool the formed part 5, a coolant KM, normally water, is injected form a coolant source 14 (FIG. 5) via the supply lines 7 and the branching injection lines 8 into the cavity 4 of the thermoforming mold 1 and thus into the gap 6 and also into air gaps 10 that are present between the formed part 5 and contact surfaces 9 of the cavity 4. It will be appreciated by persons skilled in the art that the thermoforming mold 1 must contain much further devices which do not appear in the foregoing Figure, e.g. pressure generator and/or pressure accumulator, control devices for adjusting the coolant pressure, coolant amount, time duration of the coolant supply, temperature measuring elements. However, these devices have been omitted from the Figures for the sake of simplicity.

A direct cooling action is implemented in the cavity 4 by injecting or forcing coolant KM into the cavity 4 to directly come into contact with the formed part 5. The overall coolant supply together with the supply lines 7, injection lines 8 and pertaining pressure-based devices are part of a first cooling system which operates in the high pressure range, with the pressure and the state of aggregation of the coolant KM being adjustable by a control device 13, shown schematically in FIG. 5.

The top and bottom dies 2, 3 further include cooling channels 11 which are part of a second cooling system which provides an indirect cooling of the formed part 5. Coolant, normally water, is routed through the cooling channels 11 and absorbs heat given off by the hot formed part 5 onto the top and bottom dies 2, 3 of the thermoforming mold 1 and carries it to the outside. In the second cooling system, coolant is circulated in a cooling circuit with recooling. While the coolant KM in the first cooling system is maintained under high pressure, the coolant in the second cooling system is maintained at a pressure of up to 6 bar.

Figure 2:
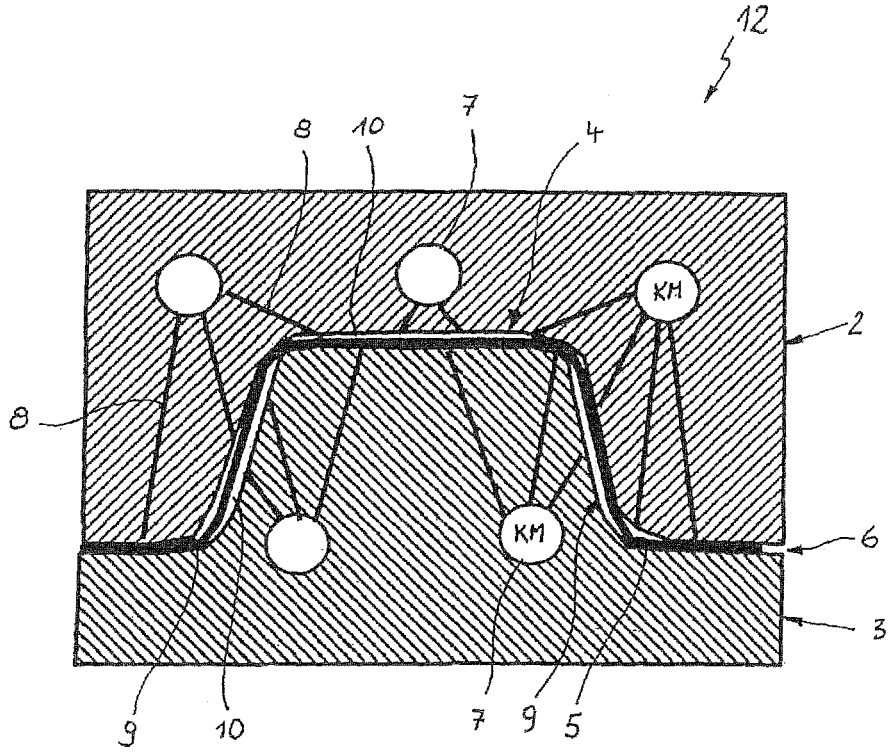
FIG. 2 is a schematic vertical section of a second embodiment of a thermoforming mold according to the present invention.

Referring now to FIG. 2, there is shown schematic vertical section of a second embodiment of a thermoforming mold according to the present invention, generally designated by reference numeral 12. Parts corresponding with those in FIG. 1 are denoted by identical reference numerals and not explained again. The description below will center on the differences between the embodiments. In this embodiment, provision is made for a direct cooling only. The thermoforming mold 12 does not have an indirect cooling, i.e. there are no separate cooling channels 11 in the top and bottom dies, 2, 3 for dissipating heat from the thermoforming mold 12. Otherwise, the thermoforming mold 12 corresponds to the thermoforming mold 1 so that further discussion has been omitted for the sake of simplicity.

Figure 3:
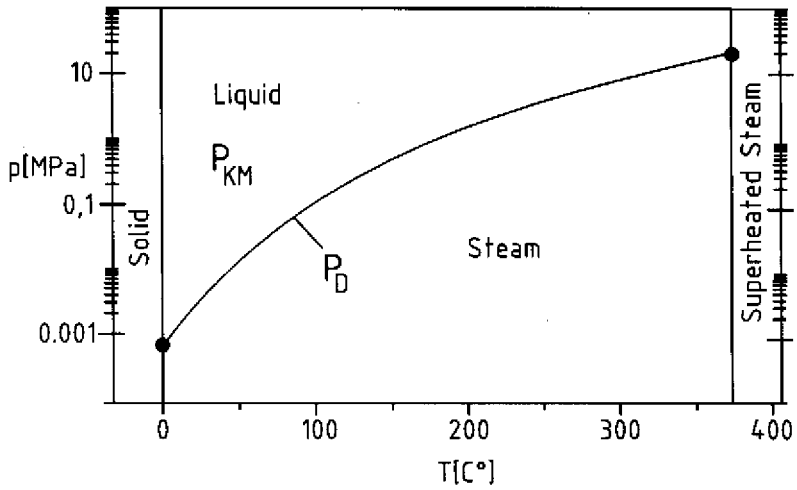
FIG. 3 is a graphical illustration of a steam pressure curve of water.

Basic Principle:

The configuration of the thermoforming mold 1, 12 allows coolant KM to be introduced in to the cavity 4 and the gap 6 at a pressure $p_{KM}$ above the steam pressure $p_D$ of the coolant KM. This ensures a stable liquid phase of the coolant KM, and as a result a superior heat transfer and heat dissipation to realize a superior cooling effect. Air gaps 10 between the contact surface 9 of the cavity 4 and the formed part 5, caused by manufacturing tolerances and/or wear, are closed by the coolant KM. As the coolant KM, normally water, is maintained under high pressure $p_{KM}$ above the steam pressure $p_D$, evaporation is prevented when the coolant KM comes into contact with the hot surface of the formed part 5. Cooling is even across the entire surface of the formed part 5. There are no zones of inferior heat conduction as a result of steam formation. FIG. 3 shows a curve of a steam pressure $p_D$ of water. In accordance with a basic principle of the invention, a liquid state of aggregation of the coolant KM is provided in which the pressure $p_{KM}$ of the coolant KM is adjusted during the cooling phase to a range above the steam pressure $p_D$. A large volume flow of water is forced in a time-controlled fashion at a pressure $p_{KM}$ of up to 25 MPa into the cavity 4 of the closed thermoforming mold 1, 12 and into the air gap 10. As water under high pressure is injected into the cavity 4 and thus fills the mold gap 6 and the air gap 10, the heat transfer is superior to ensure a highly efficient cooling action. No evaporation of water and no formation of an unwanted insulating steam film take place. The heat transfer is just like a heat transfer when a mold contact across an entire surface is involved.

Example 1

The hardness of the formed part 5 can be controlled in a desired manner by timing the start of injection of coolant KM and end of injection of coolant KM and by controlling the pressure level. The minimum hardness corresponds to a hardness which is attained at a particular locking time without injection cooling in the formed part. The maximum hardness depends on material properties and the alloying concept of the formed part material. The control of the start of injection and end of the injection can also be realized by online measurement of the temperature of the formed part 5 in the mold 1, 12 or of the temperature on the mold 1, 12. The temperature of the formed part 5 is hereby measured in the cavity 4. The mold temperature is measured in the area of the contact surfaces 9 of the cavity 4. The start of injection and the end of injection of coolant KM is controlled in dependence on the temperature of the formed part 5 and/or the mold temperature.

Example 2

Figure 7:
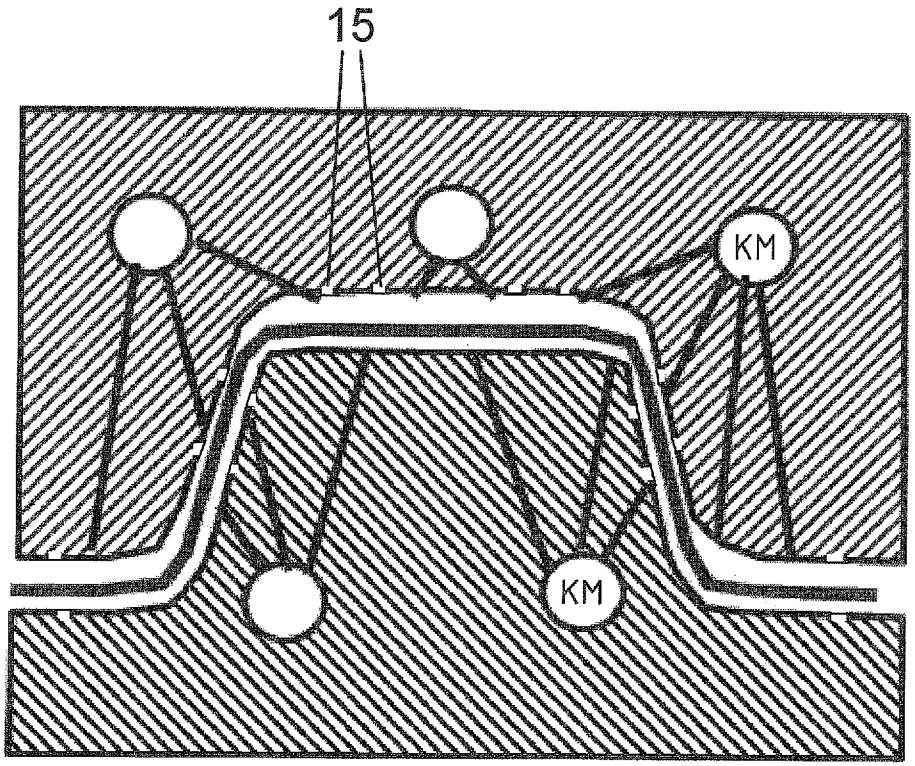
FIG. 7 is a schematic vertical section of the thermoforming mold of FIG. 1 with illustration of a measure to influence heat transmission by way of example.

As a result of the possible short locking times of the thermoforming mold 1, 12, formed parts 5 can be produced having regions of different hardness by cooling only these regions of the formed part 5 in the cavity 4 with coolant KM. This can be realized by a selective coolant injection in targeted regions of the cavity 4 that correspond to the regions of the formed part 5 that should be made hard, once the formed part 5 is removed from the mold 1, 12. In mild regions of the formed part 5, i.e. regions of lesser strength after undergoing the hot forming and press-hardening operations, any cooling action may also be delayed by providing the contact surfaces 9 of the cavity 4 with a measure to influence the heat transmission. Such a measure may involve, for example, heating elements, clearances, air gaps, inserts of material with lesser or higher thermal conductivity or ceramic inserts. By way of example, FIG. 7 shows the presence of clearances 15.

Figure 6:
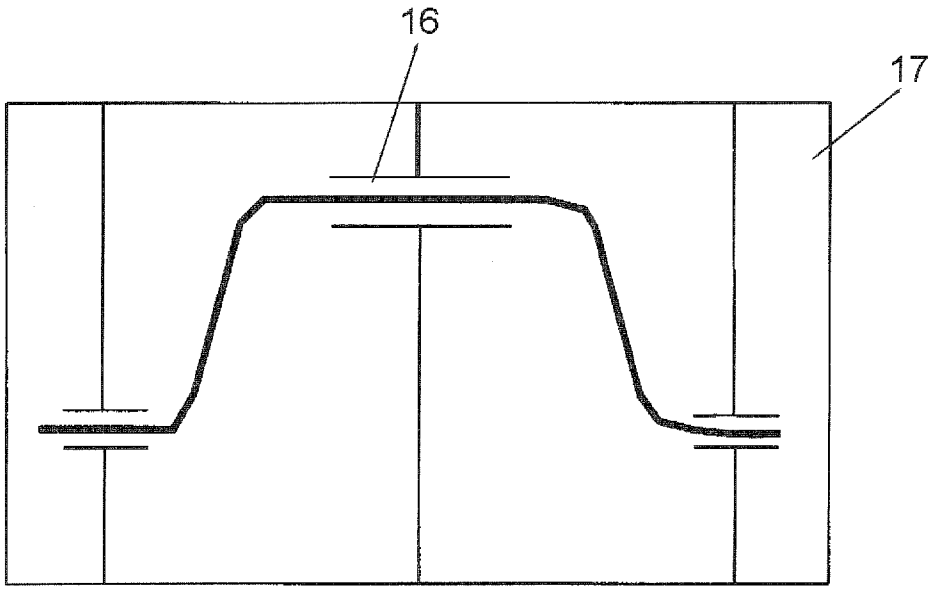
FIG. 6 is a schematic illustration of a cooling station.

A formed part 5 is removed from the thermoforming mold 1, 12, having at least two regions which have different temperatures. This formed part 5 is held in place by appropriate clamping members 16 in a separate cooling station 17, shown by way of example in FIG. 6, for undergoing additional cooling. In this way, the soft mild areas can undergo a defined cooling so as to eliminate the presence of any distortion of the formed part 5.

Example 3

Figure 4:
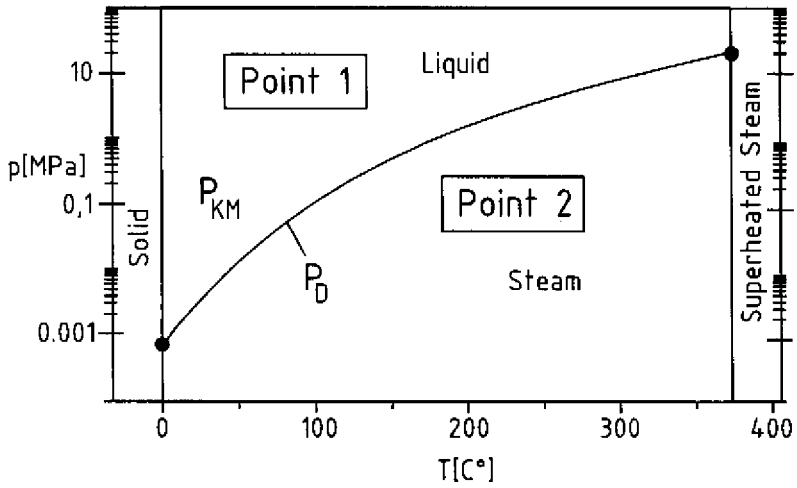
FIG. 4 is a graphical illustration of a steam pressure curve of water, depicting two points of different pressure level which represents different states of aggregation of water.

A variation of the injection time in combination with a variation of the injection pressure $p_{KM}$ permits the realization of a formed part 5 with areas of different heat transmission coefficients. Depending on the injection pressure $p_{KM}$, a water layer with good heat conductivity and a wet steam with poorer heat conductivity can be realized in the cavity 4 and gap 6 between the top and bottom dies 2, 3. The two operating points of the coolant pressure are shown in FIG. 4. Point 1 is in the range of stable liquid phase above the curve of the steam pressure $p_D$. Point 2 is in the wet steam range below the curve of the pressure $p_D$. This affords another option to tailor the properties of the formed part 5.

Example 4

When operating with high-pressure injection cooling in the wet steam range, a thermoforming mold can be constructed in the absence of a conventional cooling. Such a thermoforming mold is the thermoforming mold 12, as shown in FIG. 2, which is not equipped with an indirect cooling system.

When operating in the wet steam range, heat energy from the formed part 5 is used to transform water from the liquid phase into the gaseous phase. To prevent formation of a closed water film in the gap 6, the injection pressure $p_{KM}$ is adjusted in a time-controlled manner or in accordance with a temperature measurement. As an alternative, the mold temperature on the thermoforming mold 1 or in the area of the contact surfaces 9 of the cavity 4 are measured and continuously suited to the steam pressure $p_D$.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method of producing a hardened formed part, in particular for a structure or body part of a motor vehicle, said method comprising the steps of:

heating a metal blank;

hot forming the metal blank in a cavity of a thermoforming mold into a formed part;

hardening the formed part in the cavity of the thermoforming mold through contact with a coolant fed into the cavity via feed channels, and adjusting a state of aggregation of the coolant between a liquid state, a vaporous state and a gaseous state.

2. The method of claim 1, wherein the coolant is introduced into the cavity at a pressure of up to 25 MPa.

3. The method of claim 1, further comprising the step of varying a duration of supply of coolant into the cavity and/or varying a pressure level of the coolant.

4. The method of claim 1, further comprising the step of measuring a temperature of the formed part in the cavity.

5. The method of claim 1, further comprising the step of measuring a temperature of the mold in an area of contact surfaces of the cavity.

6. The method of claim 1, further comprising the step of controlling a starting time and an end time of supply of coolant into the cavity in dependence on a temperature of the formed part and/or a temperature of the mold.

7. The method of claim 1, further comprising the step of variably controlling a coolant distribution in the cavity.

8. The method of claim 7, wherein a first region of the formed part is contacted by the coolant whereas a second region of the formed part is prevented from contacting the coolant.

9. The method of claim 7, wherein first and second regions of the formed part are contacted by the coolant in a time-staggered sequence.

10. The method of claim 1, further comprising the steps of removing the formed part from the thermoforming mold and securing the formed part in place in a cooling station.

11. The method of claim 1, further comprising the step of introducing the coolant into the cavity at a pressure to suit a steam pressure of the coolant during a cooldown phase of the formed part.

12. The method of claim 1, wherein the pressure of the coolant is time-controlled and/or temperature-controlled.

13. The method of claim 1, wherein the pressure of the coolant is temperature-controlled in dependence of a temperature measurement on the formed part in the thermoforming mold and/or a temperature measurement on the thermoforming mold.

14. The method of claim 1, wherein the coolant is injected intermittently into the cavity.

15. A thermoforming mold for shaping and hardening a metal sheet, comprising:

a top die;

a bottom die, said top and bottom dies defining a cavity there between, wherein at least one member of the group of top die and bottom die has feed passageways for conducting a coolant into the cavity; and a control device constructed to adjust a state of aggregation of the coolant between a liquid state, a vaporous state and a gaseous state.

16. The thermoforming mold of claim 15, wherein the control device is constructed to vary a pressure of the coolant injected into the cavity and/or to control a pressure level and/or injection duration of the coolant into the cavity.

17. The thermoforming mold of claim 15, wherein the feed passageways include supply lines and injection lines branching off the supply lines and porting into the cavity.

18. The thermoforming mold of claim 15, wherein contact surfaces of the cavity are constructed to include means for influencing a heat transmission.

* * * * *

UNITED STATES PATENT AND TRADEMARK OFFICE

CERTIFICATE OF CORRECTION

PATENT NO. : 8,707,751 B2
APPLICATION NO. : 13/050500
DATED : April 29, 2014
INVENTOR(S) : Christian Hielscher et al.

It is certified that error appears in the above-identified patent and that said Letters Patent is hereby corrected as shown below:

Title Page, (74) Please change "Feiereisen LLC" to -- Henry M. Feiereisen LLC --.

In the Specification

Column 4, line 42: Please change "thermoforming mod 1" to -- thermoforming mold 1 --.

Column 4, line 59: Please change "injected form a" to -- injected from a --.

Signed and Sealed this
Fifth Day of August, 2014

Michelle K. Lee

Michelle K. Lee
*Deputy Director of the United States Patent and Trademark Office*